US012584640B2

(12) United States Patent
Saeki et al.

(10) Patent No.: US 12,584,640 B2
(45) Date of Patent: Mar. 24, 2026

(54) VENTILATOR

(71) Applicant: DAIKIN INDUSTRIES, LTD., Osaka (JP)

(72) Inventors: Kumiko Saeki, Osaka (JP); Yuta Iyoshi, Osaka (JP); Yoshiki Yamanoi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/602,740

(22) Filed: Mar. 12, 2024

(65) Prior Publication Data

US 2024/0210049 A1 Jun. 27, 2024

Related U.S. Application Data

(63) Continuation of application No. PCT/JP2022/029587, filed on Aug. 2, 2022.

(30) Foreign Application Priority Data

Sep. 30, 2021 (JP) ..... 2021-160922

(51) Int. Cl.
*F24F 5/00* (2006.01)
*F24F 12/00* (2006.01)

(52) U.S. Cl.
CPC ..... *F24F 5/001* (2013.01); *F24F 12/002* (2013.01)

(58) Field of Classification Search
CPC ..... F24F 5/001; F24F 12/002
See application file for complete search history.

(56) References Cited

U.S. PATENT DOCUMENTS 2,817,217 A 12/1957 Winkler
3,988,900 A 11/1976 Kamata et al.
(Continued)

FOREIGN PATENT DOCUMENTS

CN 1356509 A 7/2002
CN 204153894 U 2/2015
(Continued)

OTHER PUBLICATIONS

Lee (KR20200112070A), English Translation, 2020, Whole Document (Year: 2020).*
(Continued)

*Primary Examiner* — Larry L Furdge
*Assistant Examiner* — Keith Stanley Myers
(74) *Attorney, Agent, or Firm* — Osha Bergman Watanabe & Burton LLP

(57) ABSTRACT

A ventilator includes: a refrigerant circuit through which a refrigerant flows and that includes a compressor, first heat exchangers, and a second heat exchanger that are connected by a refrigerant pipe; air supply fans that supply air from an outdoor space to indoor spaces through the first heat exchangers; an exhaust fan that exhausts air from the indoor spaces to the outdoor space through the second heat exchanger; an exhaust-side casing that accommodates the exhaust fan; air supply-side casings that accommodate the air supply fans; and air supply units that accommodate the first heat exchangers and the air supply fans in the air supply-side casings. The exhaust-side casing is separated from the air supply-side casings. The exhaust fan and the exhaust-side casing are disposed in the outdoor space. The air supply units individually supply the air from the outdoor space to the indoor spaces.

9 Claims, 9 Drawing Sheets

(56) References Cited

U.S. PATENT DOCUMENTS

| | | | | |
|---|---|---|---|---|
| 5,372,182 | A | 12/1994 | Gore | |
| 5,709,097 | A | 1/1998 | Kim et al. | |
| 6,038,879 | A | 3/2000 | Turcotte et al. | |
| 6,347,527 | B1 | 2/2002 | Bailey et al. | |
| 9,470,427 | B2 | 10/2016 | Sakai et al. | |
| 9,599,353 | B2 | 3/2017 | Cur et al. | |
| 10,344,990 | B2 | 7/2019 | Baetens et al. | |
| 11,187,418 | B1 | 11/2021 | DeLoach et al. | |
| 11,609,013 | B2 | 3/2023 | Tamura et al. | |
| 11,655,990 | B2 | 5/2023 | Chen et al. | |
| 11,655,996 | B2 | 5/2023 | Kazimirovich et al. | |
| 11,850,912 | B2 | 12/2023 | Heering | |
| 2007/0082601 | A1* | 4/2007 | Desrochers | G01N 1/26 454/239 |
| 2020/0080742 | A1* | 3/2020 | Okamoto | G05B 17/02 |
| 2021/0108805 | A1 | 4/2021 | Imaizumi et al. | |

FOREIGN PATENT DOCUMENTS

| | | | | |
|---|---|---|---|---|
| CN | 104603546 | A | 5/2015 | |
| CN | 106524317 | A | 3/2017 | |
| DE | 202004018206 | U1 | 1/2005 | |
| EP | 3792565 | A1 | 3/2021 | |
| GB | 828979 | A | 2/1960 | |
| JP | S52-115548 | A | 9/1977 | |
| JP | S61-36641 | A | 2/1986 | |
| JP | S62-237231 | A | 10/1987 | |
| JP | H07-33057 | Y2 | 7/1995 | |
| JP | 2001-116321 | A | 4/2001 | |
| JP | 2002-276999 | A | 9/2002 | |
| JP | 2005-265401 | A | 9/2005 | |
| JP | 2006-162145 | A | 6/2006 | |
| JP | 2009-8317 | A | 1/2009 | |
| JP | 2010-127522 | A | 6/2010 | |
| JP | 6250148 | B2 | 12/2017 | |
| JP | 6708369 | B2 | 6/2020 | |
| JP | 2020-186822 | A | 11/2020 | |
| JP | 2021-042918 | A | 3/2021 | |
| KR | 1004640 | B1 * | 1/2011 | G06F 3/0607 |
| KR | 20200112070 | A * | 10/2020 | F24F 12/002 |
| WO | 2014-091541 | A1 | 6/2014 | |
| WO | 2020/053929 | A1 | 3/2020 | |

OTHER PUBLICATIONS

Cho et al. (KR101004640B1), English Translation, A heat exchanger for inner ventilation, 2011, Whole Document (Year: 2011).*

International Preliminary Report on Patentability issued in corresponding International Application No. PCT/ JP2022/029587, dated Apr. 2, 2024 (5 pages).

International Preliminary Report on Patentability issued in related International Application No. PCT/JP2022/029601, dated Apr. 2, 2024 (5 pages).

International Search Report issued in corresponding International Application No. PCT/JP2022/029587 mailed Oct. 11, 2022 (2 pages).

International Search Report issued in related International Application No. PCT/JP2022/029601 mailed Oct. 11, 2022 (3 pages).

Decision of Refusal issued in corresponding Japanese Application No. 2021-160922 mailed Mar. 7, 2023 (8 pages).

Decision to Grant a Patent in corresponding Japanese Application No. 2021-160922 mailed Jul. 11, 2023 (5 pages).

Extended European Search Report issued in European Application No. 22875588.0 dated Dec. 12, 2024 (7 pages).

Extended European Search Report issued in related Application No. 22875589.8 dated Dec. 19, 2024 (9 pages).

* cited by examiner

VENTILATOR

TECHNICAL FIELD

The present disclosure relates to a ventilator.

BACKGROUND

Conventionally, there has been known a ventilator that includes a heat exchanger, an air supply path and an air exhaust path that allow an inside and an outside of a target space to communicate with each other via the heat exchanger, an air supply fan that supplies air outside the target space into the target space via the air supply path, and an air exhaust fan that exhausts air in the target space to the outside of the target space via the air exhaust path, and is capable of performing a class 1 ventilation (balanced ventilation) (see Patent Literature 1). The ventilator described in Patent Literature 1 uses a total heat exchanger as a heat exchanger, and performs heat exchange (heat recovery) by the total heat exchanger between the air flowing through the air supply path and the air flowing through the air exhaust path.

PATENT LITERATURE

PATENT LITERATURE 1: Japanese Laid-Open Patent Publication No. 2020-186822

SUMMARY

A ventilator of the present disclosure includes a refrigerant circuit through which a refrigerant flows, the refrigerant circuit including a compressor, a first heat exchanger, and a second heat exchanger that are connected by a refrigerant pipe, an air supply fan that supplies air in an outdoor space to an indoor space through the first heat exchanger, an exhaust fan that exhausts air in the indoor space to the outdoor space through the second heat exchanger, and an exhaust-side casing that accommodates the exhaust fan, in which the exhaust fan and the exhaust-side casing are disposed in the outdoor space.

DETAILED DESCRIPTION

Outline of Ventilator

Figure 1:
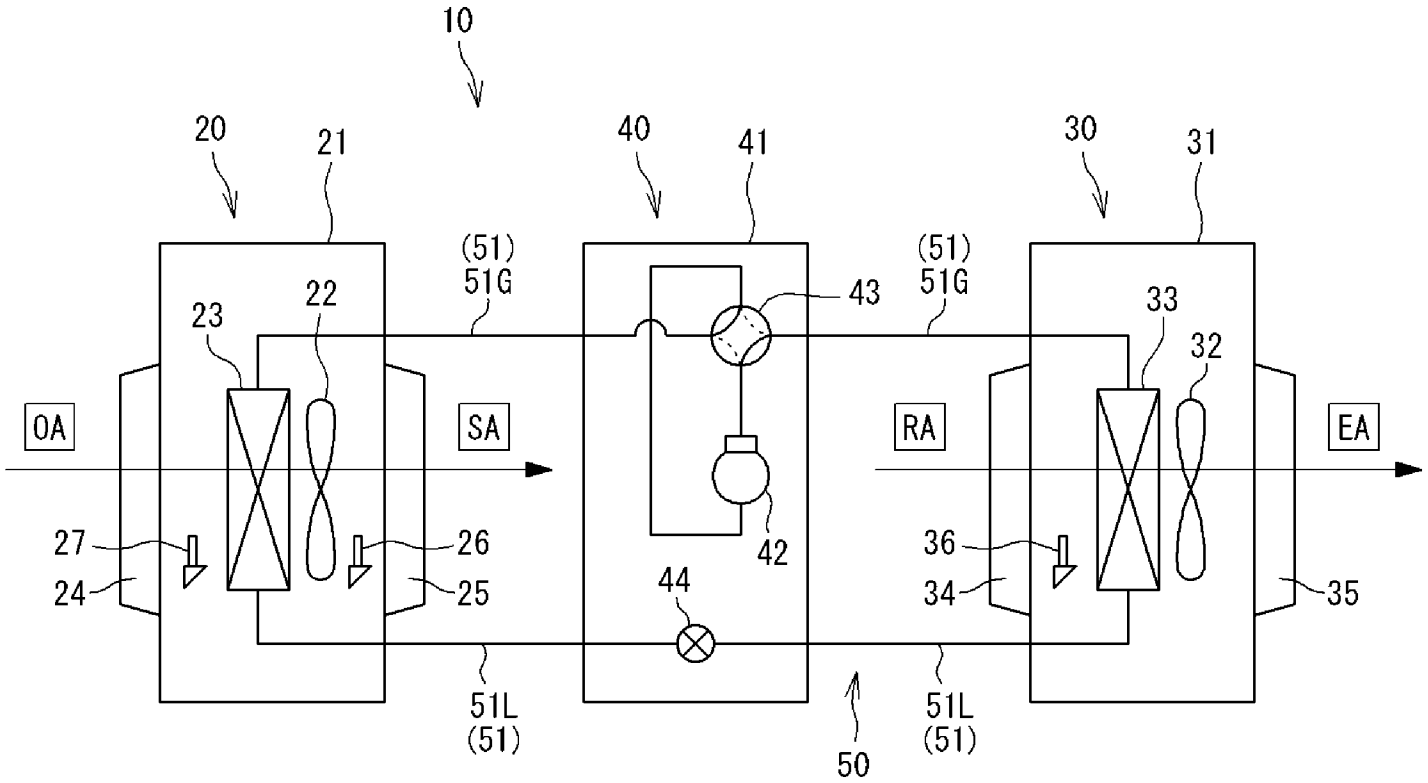
FIG. 1 is a schematic configuration diagram of a ventilator of the present disclosure.

FIG. 1 is a schematic configuration diagram of a ventilator of the present disclosure. In the following description, a ventilator 10 (see FIG. 2, FIG. 3, and FIG. 5) according to a first embodiment will be referred to as a first ventilator 11, a ventilator 10 (see FIG. 6) according to a second embodiment will be referred to as a second ventilator 12, a ventilator 10 (see FIG. 7) according to a third embodiment will be referred to as a third ventilator 13, a ventilator 10 (see FIG. 8) according to a fourth embodiment will be referred to as a fourth ventilator 14, and a ventilator 10 (see FIG. 9) according to a fifth embodiment will be referred to as a fifth ventilator 15. In the following description, a configuration common to the first to fifth ventilators 11 to 15 will be described when the ventilators are simply referred to as "ventilator 10".

The ventilator 10 shown in FIG. 1 is an embodiment of the ventilator of the present disclosure, and is installed in a building such as an office building or a factory to implement ventilation of a target space. The ventilator 10 includes an air supply unit 20, an exhaust unit 30, a compressor unit 40, and a refrigerant circuit 50.

The air supply unit 20 includes an air supply-side casing 21, an air supply fan 22, and a first heat exchanger 23. The air supply-side casing 21 according to the present embodiment may be a cubic box constituted with a panel member having a heat insulating property, and may have side surfaces provided with a suction port 24 and a blow-out port 25. The air supply fan 22 and the first heat exchanger 23 are disposed in the air supply-side casing 21. When the air supply fan 22 is driven, the air supply unit 20 can take air (outside air OA) in an outdoor space S2 into the air supply-side casing 21, exchange the taken air with a refrigerant in the first heat exchanger 23, and then release the air as a supply air SA from the blow-out port 25 toward an indoor space S1.

The first heat exchanger 23 constitutes the refrigerant circuit 50 described later. The first heat exchanger 23 is a cross-fin tube type or microchannel type heat exchanger, and is used to exchange heat between the refrigerant flowing in the first heat exchanger 23 and the air (outside air OA) in the outdoor space S2.

The air supply unit 20 further includes a supply air temperature sensor 26 and an outside air temperature sensor 27. The supply air temperature sensor 26 is disposed in an airflow after passing through the first heat exchanger 23 in the air supply-side casing 21, and can detect a temperature of the supply air SA. The outside air temperature sensor 27 is disposed in an airflow before passing through the first heat exchanger 23 in the air supply-side casing 21, and can detect a temperature of the outside air OA.

The exhaust unit 30 includes an exhaust-side casing 31, an exhaust fan 32, and a second heat exchanger 33. The exhaust-side casing 31 according to the present embodiment may be a cubic box constituted with a panel member having a heat insulating property, and may have side surfaces provided with a suction port 34 and a blow-out port 35. The exhaust fan 32 and the second heat exchanger 33 are disposed in the exhaust-side casing 31. When the exhaust fan 32 is driven, the exhaust unit 30 can take air in the indoor space S1 (return air RA) into the exhaust-side casing 31, cause the taken air and the refrigerant in the second heat exchanger 33 to exchange heat with each other, and then discharge the air as exhaust air EA from the blow-out port 35 toward the outdoor space S2.

The second heat exchanger 33 constitutes the refrigerant circuit 50 described later. The second heat exchanger 33 is a cross-fin tube type or microchannel type heat exchanger, and is used to exchange heat between the refrigerant flowing in the second heat exchanger 33 and the air in the indoor space S1.

The exhaust unit 30 further includes a return air temperature sensor 36. The return air temperature sensor 36 is disposed in an airflow before passing through the second heat exchanger 33 in the exhaust-side casing 31, and can detect a temperature of the return air RA.

The compressor unit 40 includes a casing 41, a compressor 42, a four-way switching valve 43, and an expansion valve 44.

The compressor 42 sucks a low-pressure gaseous refrigerant and discharges a high-pressure gaseous refrigerant. The compressor 42 includes a motor having the number of operating revolutions adjustable in accordance with inverter control. The compressor 42 is of a variable capacity type (performance variable type) having capacity (performance) variable in accordance with inverter control of the motor. Alternatively, the compressor 42 may be of a constant capacity type. The compressor 42 used in the ventilator 10 of the present disclosure may be configured by connecting two or more compressors in parallel.

The four-way switching valve 43 reverses a refrigerant flow in a refrigerant pipe, and switchingly supplies one of the first heat exchanger 23 or the second heat exchanger 33 with the refrigerant discharged from the compressor 42. Accordingly, the ventilator 10 can switch between a cooling operation for cooling the outside air OA and a heating operation for heating the outside air OA. The expansion valve 44 is constituted by an electric valve capable of adjusting a flow rate and a pressure of a refrigerant. In the ventilator 10, an opening degree of the expansion valve 44 is controlled to adjust the pressure of the refrigerant to be supplied to the first heat exchanger 23.

The refrigerant circuit 50 includes the compressor 42, the four-way switching valve 43, the expansion valve 44, the first heat exchanger 23, the second heat exchanger 33, and a refrigerant pipe 51 (a liquid pipe 51L and a gas pipe 51G) connecting the above components. The refrigerant circuit 50 circulates the refrigerant between the first heat exchanger 23 and the second heat exchanger 33.

In the ventilator 10 having the above configuration, when the outside air OA is cooled and supplied by the air supply unit 20, the four-way switching valve 43 is held in a state indicated by a solid line in FIG. 1. The high-temperature and high-pressure gaseous refrigerant discharged from the compressor 42 flows into the second heat exchanger 33 of the exhaust unit 30 through the four-way switching valve 43. At this time, the second heat exchanger 33 functions as a condenser, and causes heat exchange with the return air RA by an activation of the exhaust fan 32 to condense and liquefy the refrigerant. The liquefied refrigerant is decompressed by the expansion valve 44 and flows into the first heat exchanger 23. At this time, the first heat exchanger 23 functions as an evaporator, and in the first heat exchanger 23, the refrigerant exchanges heat with the outside air OA and evaporates. The outside air OA cooled by the evaporation of the refrigerant is supplied to the indoor space S1 as the supply air SA by the air supply fan 22. The refrigerant evaporated in the first heat exchanger 23 returns to the compressor unit 40 through the refrigerant pipe 51 (gas pipe 51G), and is sucked into the compressor 42 through the four-way switching valve 43.

In the ventilator 10 having the above configuration, when the outside air OA is heated and supplied by the air supply unit 20, the four-way switching valve 43 is held in a state indicated by a broken line in FIG. 1. The high-temperature and high-pressure gaseous refrigerant discharged from the compressor 42 passes through the four-way switching valve 43 and flows into the first heat exchanger 23 of the air supply unit 20. At this time, the first heat exchanger 23 functions as a condenser, and the refrigerant exchanges heat with the outside air OA and to be condensed and liquefied in the first heat exchanger 23. The outside air OA heated by the condensation of the refrigerant is supplied to the indoor space S1 by the air supply fan 22. The refrigerant liquefied in the first heat exchanger 23 reaches the compressor unit 40 through the refrigerant pipe 51 (liquid pipe 51L), is decompressed to a predetermined low pressure by the expansion valve 44, and further flows into the second heat exchanger 33. At this time, the second heat exchanger 33 functions as an evaporator, and the refrigerant exchanges heat with the return air RA and evaporates in the second heat exchanger 33. The refrigerant evaporated and vaporized in the second heat exchanger 33 is sucked into the compressor 42 through the four-way switching valve 43.

Figure 3:
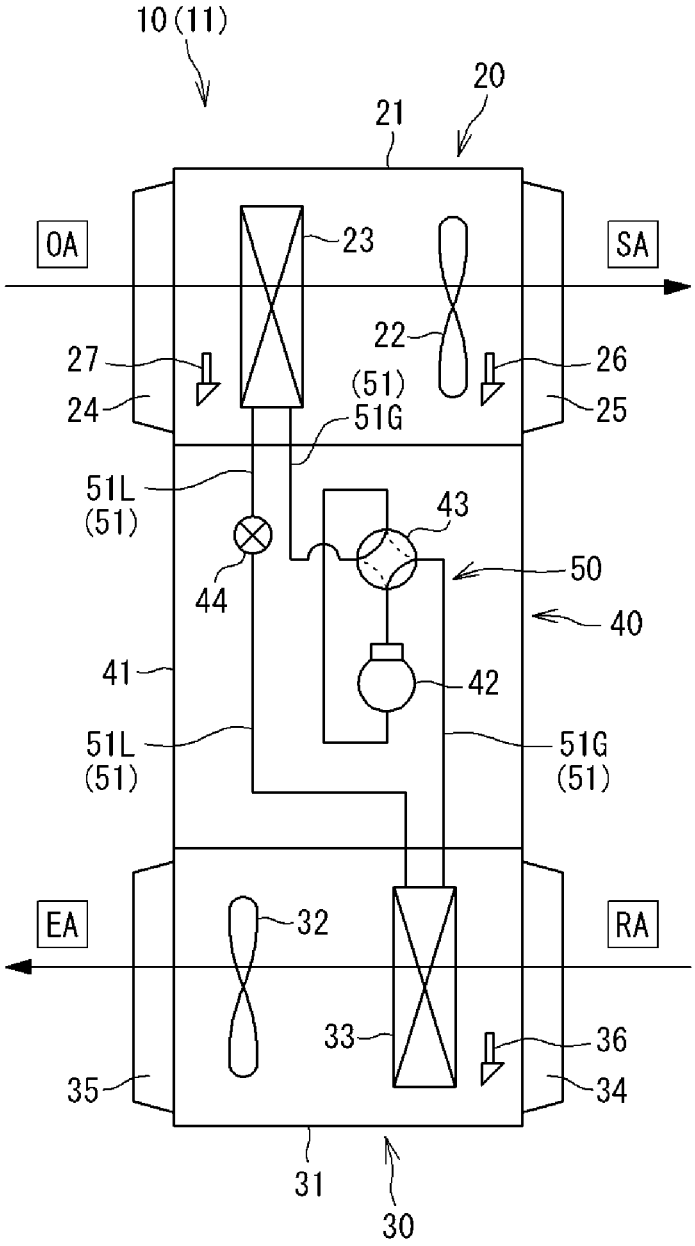
FIG. 3 is a schematic configuration diagram of the ventilator according to the first embodiment of the present disclosure.
Figure 4:
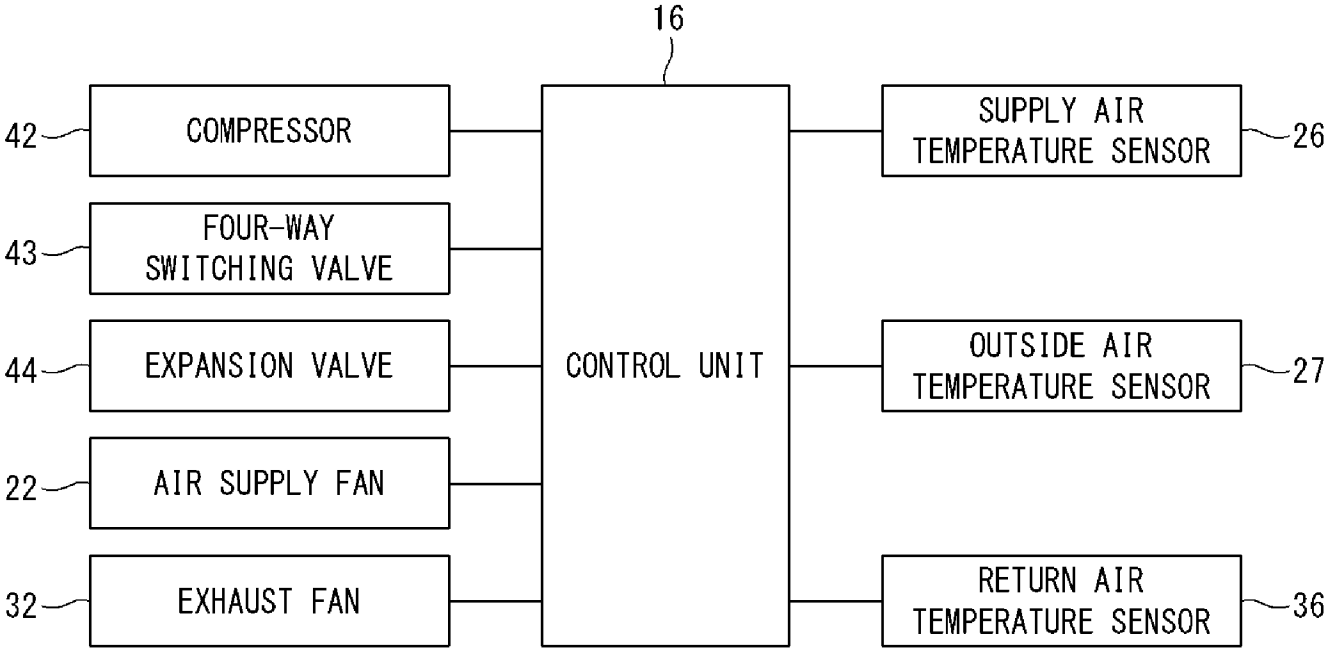
FIG. 4 is a control block diagram of the ventilator of the present disclosure.

FIG. 3 is a control block diagram of the ventilator. The ventilator 10 includes a control unit 16 shown in FIG. 3. The control unit 16 is configured to control operation of the ventilator 10, and is constituted by, for example, a microcomputer including a processor such as a CPU and a memory such as a RAM or a ROM. The control unit 16 may alternatively be embodied as hardware with use of an LSI, an ASIC, an FPGA, or the like. The control unit 16 exerts a predetermined function when the processor executes a program installed in the memory.

The control unit 16 is connected to the air supply fan 22, the exhaust fan 32, the compressor 42, the four-way switching valve 43, and the expansion valve 44. The supply air temperature sensor 26, the outside air temperature sensor 27, and the return air temperature sensor 36 are connected to the control unit 16. The control unit 16 controls operations of the air supply fan 22, the exhaust fan 32, the compressor 42, the four-way switching valve 43, the expansion valve 44, and the like on the basis of detection values of the temperature sensors. Furthermore, a remote controller (not shown) for a user to activate or stop the ventilator 10, change settings, and the like may be connected to the control unit 16.

(First Ventilator)

Figure 2:
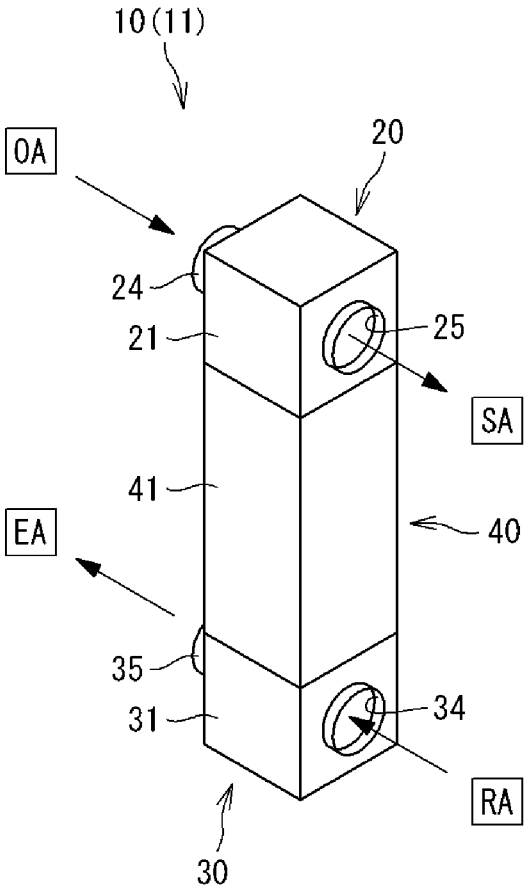
FIG. 2 is a schematic perspective view of a ventilator according to a first embodiment of the present disclosure.
Figure 5:
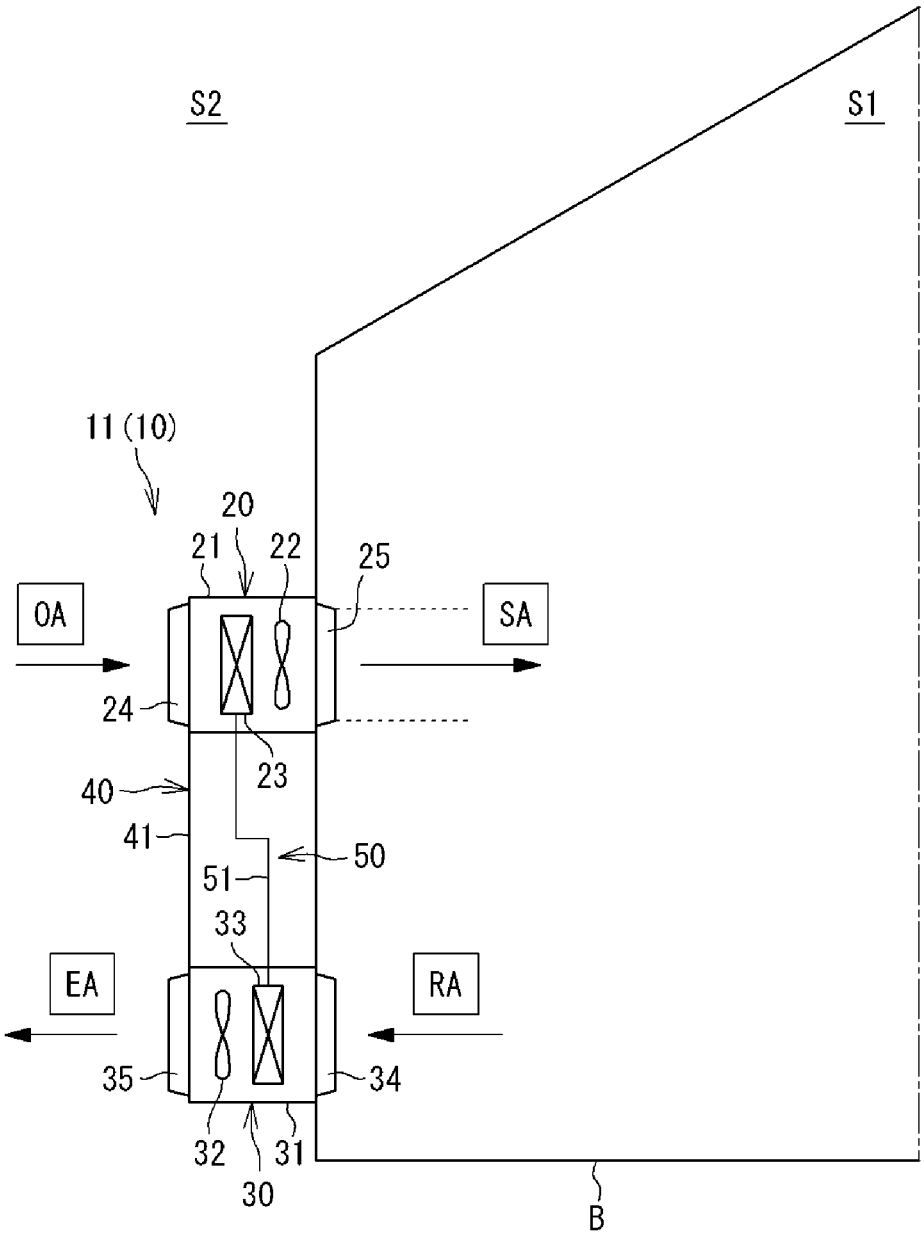
FIG. 5 is a schematic view showing a schematic arrangement of the ventilator according to the first embodiment of the present disclosure.

As shown in FIG. 2, FIG. 3, and FIG. 5, in the first ventilator 11, the air supply unit 20, the exhaust unit 30, and the compressor unit 40 are integrally configured. As shown in FIG. 5, the first ventilator 11 can be disposed in the outdoor space S2. In the present embodiment, the blow-out port 25 of the air supply unit 20 and the suction port 34 of the exhaust unit 30 may be disposed directly on an outer wall surface of a building B. In this case, a duct may be connected to the blow-out port 25 and the suction port 34 to adjust a position where the supply air SA is discharged to the indoor space S1 and a position where the return air RA is sucked from the indoor space S1.

As shown in FIG. 5, the first ventilator 11 is disposed in the outdoor space S2. In this case, the air supply-side casing 21 and the air supply fan 22, and the exhaust-side casing 31 and the exhaust fan 32 are disposed in the outdoor space S2. The first ventilator 11 can increase a distance between the air supply fan 22 and the exhaust fan 32 and the indoor space S1 as compared with a conventional ventilator in which the exhaust fan and the air supply fan are disposed the indoor space. Therefore, in the first ventilator 11, it is possible to increase a distance attenuation amount during transmission of noise generated by the air supply fan 22 and the exhaust fan 32 to the indoor space S1 as compared with the conventional ventilator. Accordingly, in the first ventilator 11, noise in the indoor space S1 can be suppressed.

(Second Ventilator)

Figure 6:
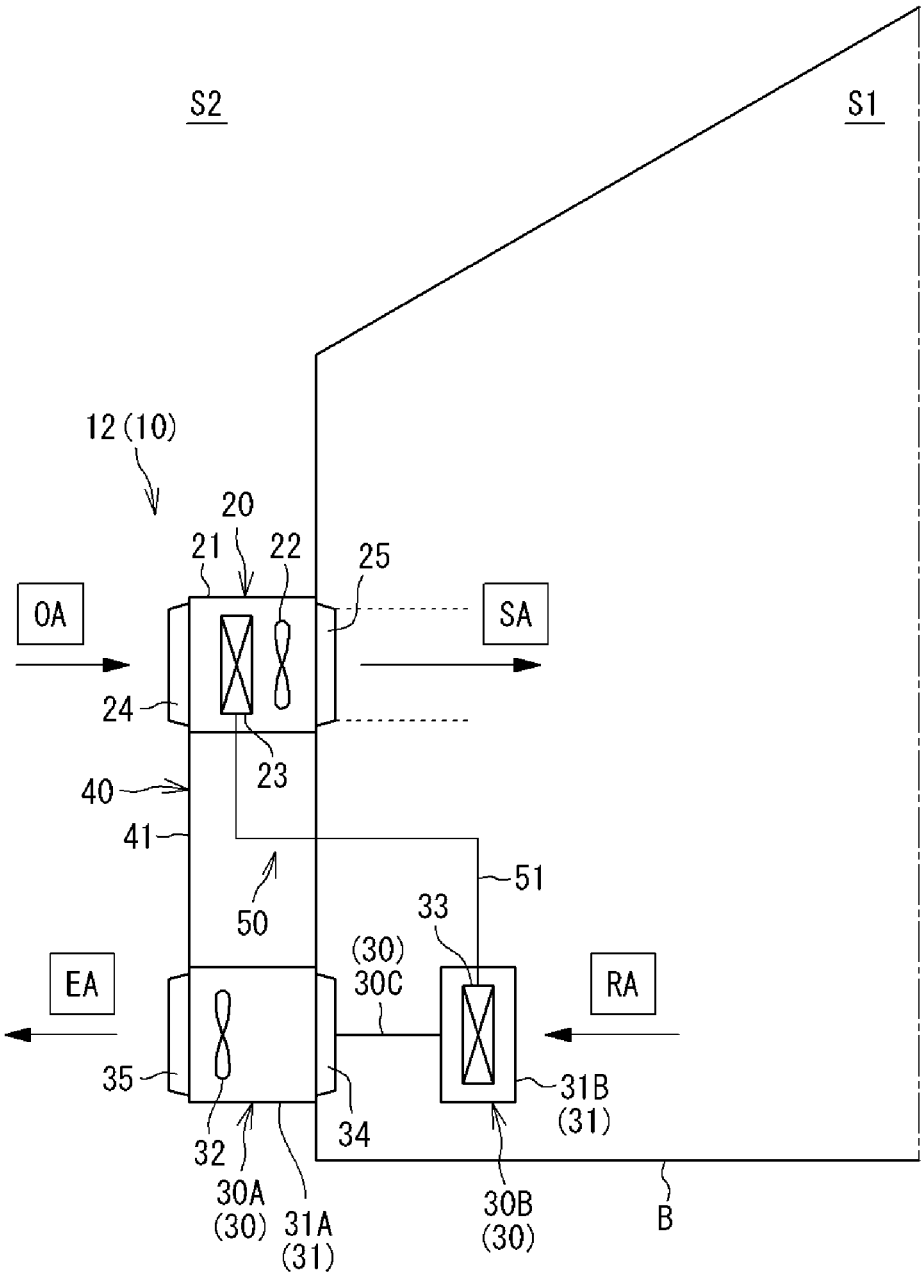
FIG. 6 is a schematic view showing a schematic arrangement of a ventilator according to a second embodiment of the present disclosure.

As shown in FIG. 6, the second ventilator 12 is different from the first ventilator 11 in that the exhaust-side casing 31 includes a first casing 31A and a second casing 31B, and the exhaust unit 30 is divided into a fan unit 30A accommodating the exhaust fan 32 in the first casing 31A and a coil unit 30B accommodating the second heat exchanger 33 in the second casing 31B. In the second ventilator 12, the air supply unit 20, the fan unit 30A, and the compressor unit 40 are integrally configured, and the coil unit 30B is a separate body. In the second ventilator 12, the fan unit 30A and the coil unit 30B are connected by a duct 30C, and the return air RA sucked from the indoor space S1 is exhausted to the outdoor space S2 through the coil unit 30B, the duct 30C, and the fan unit 30A.

As shown in FIG. 6, in second ventilator 12, a portion other than coil unit 30B is disposed in the outdoor space S2, and coil unit 30B is disposed in the indoor space S1. In this case, the air supply unit 20 and the fan unit 30A (the first casing 31A and the exhaust fan 32) are disposed in the outdoor space S2. Therefore, in the second ventilator 12, it is possible to increase the distance attenuation amount during transmission of noise generated by the air supply fan 22 and the exhaust fan 32 to the indoor space S1 as compared with the conventional ventilator. Accordingly, in the second ventilator 12, noise in the indoor space S1 can be suppressed. In the second ventilator 12, since the coil unit 30B is separated from the fan unit 30A, even when the outdoor space S2 and a ventilation target space are separated from each other, a heat recovery loss can be suppressed by arranging the second heat exchanger 33 near the ventilation target space while the noise caused by the exhaust fan 32 is suppressed. In the second ventilator 12 according to the present embodiment, the exhaust unit 30 may be divided into the fan unit 30A and the coil unit 30B, but the air supply unit 20 may also be divided into separate units of the air supply fan 22 and the first heat exchanger 23. In this case, only a unit including the first heat exchanger 23 may be disposed in the indoor space S1.

(Third Ventilator)

Figure 7:
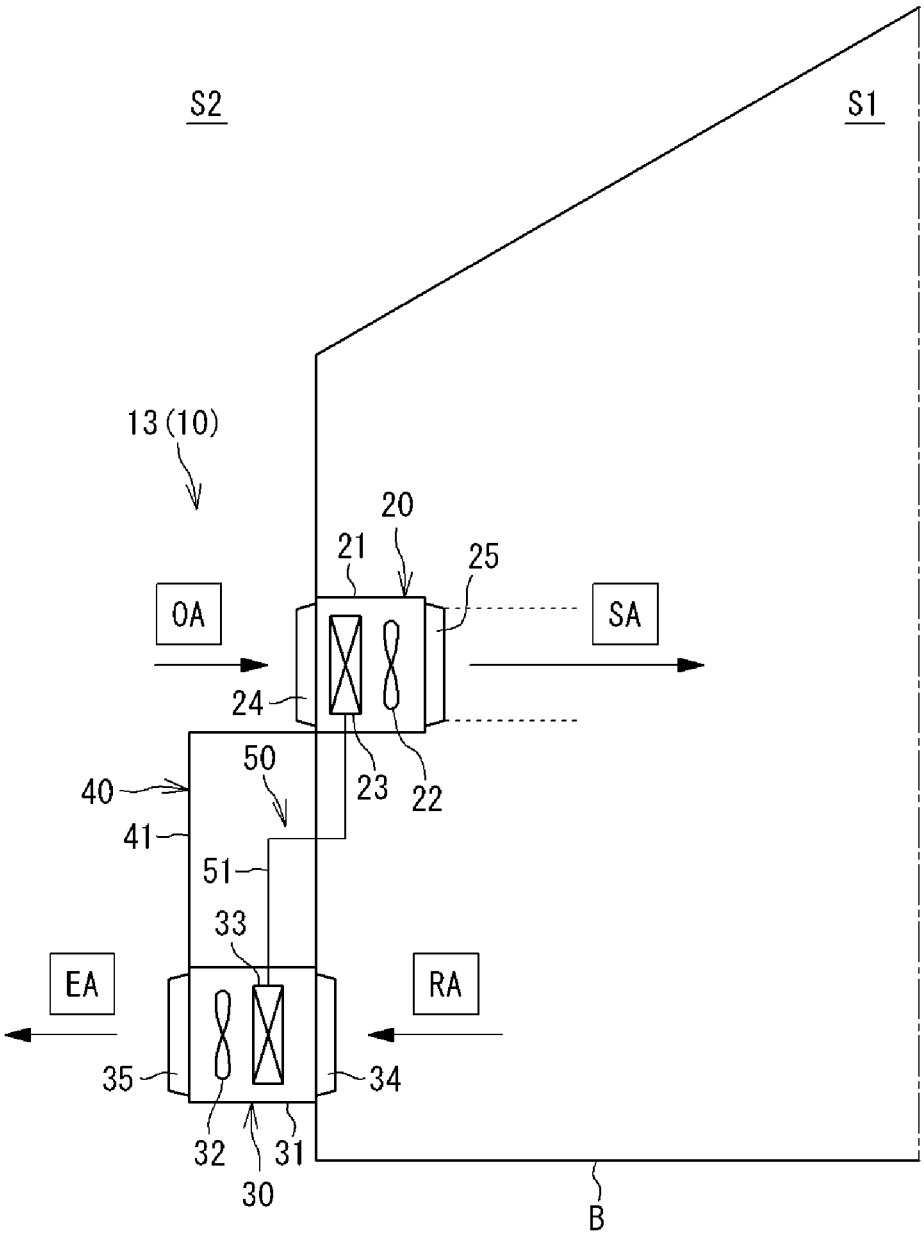
FIG. 7 is a schematic view showing a schematic arrangement of a ventilator according to a third embodiment of the present disclosure.

As shown in FIG. 7, the third ventilator 13 is different from the first ventilator 11 in that the air supply unit 20 is separated from the exhaust unit 30 and the compressor unit 40. In the third ventilator 13, the exhaust unit 30 and the compressor unit 40 are integrally configured, and the air supply unit 20 is a separate body.

As shown in FIG. 7, in the third ventilator 13, a portion other than the air supply unit 20 is disposed in the outdoor space S2, and the air supply unit 20 is disposed in the indoor space S1. In this case, the exhaust-side casing 31 and the exhaust fan 32 are disposed in the outdoor space S2. Therefore, in the third ventilator 13, it is possible to increase the distance attenuation amount during transmission of noise generated by the exhaust fan 32 to the indoor space S1 as compared with the conventional ventilator. Accordingly, in the third ventilator 13, noise in the indoor space S1 can be suppressed. In the third ventilator 13, since the air supply unit 20 is a separate body, a degree of freedom in arrangement of the air supply unit 20 is improved. In the embodiment shown in FIG. 7, the air supply unit 20 may be disposed on the outer wall of the building B. However, when a duct is connected to the suction port 24, the air supply unit 20 can be disposed near the ventilation target space away from the outer wall.

(Fourth Ventilator)

Figure 8:
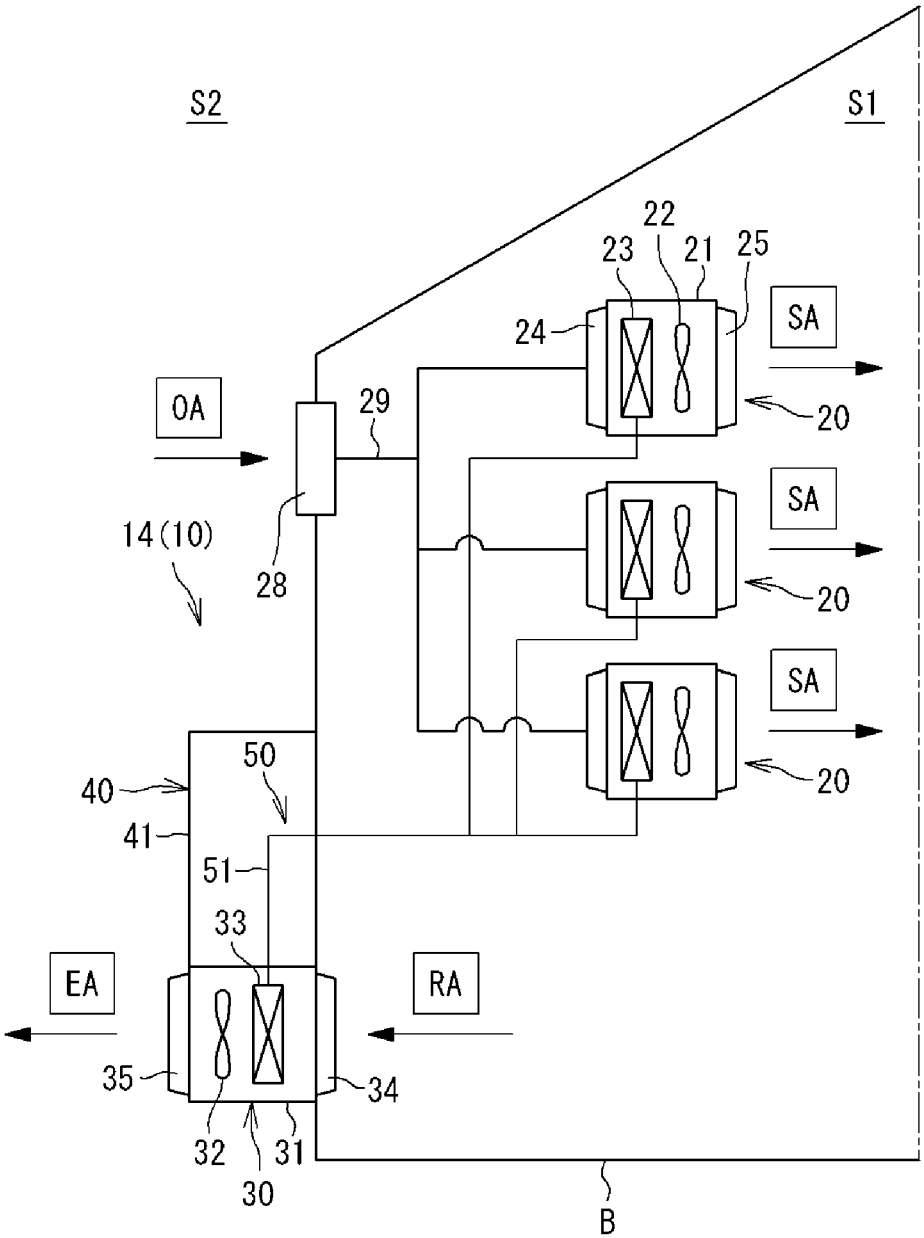
FIG. 8 is a schematic view showing a schematic arrangement of a ventilator according to a fourth embodiment of the present disclosure.

As shown in FIG. 8, the fourth ventilator 14 is different from the third ventilator 13 in that the fourth ventilator 14 includes a plurality of air supply units 20. Although the fourth ventilator 14 according to the present embodiment may include three air supply units 20, the number of the air supply units 20 in the fourth ventilator 14 is not limited to three, and may be two or more.

As shown in FIG. 8, in the fourth ventilator 14, a portion other than the plurality of air supply units 20 is disposed in the outdoor space S2, and the plurality of air supply unit 20 is disposed in the indoor space S1. In this case, the exhaust-side casing 31 and the exhaust fan 32 are disposed in the outdoor space S2. Therefore, in the fourth ventilator 14, it is possible to increase the distance attenuation amount during transmission of noise generated by the exhaust fan 32 to the indoor space S1 as compared with the conventional ventilator. Accordingly, in the fourth ventilator 14, noise in the indoor space S1 can be suppressed.

In the fourth ventilator 14, the supply air SA is supplied to the indoor space S1 by the plurality of air supply units 20, and the return air RA balanced with a total air volume of the supply air SA by the plurality of air supply units 20 is discharged as the exhaust air EA to the outdoor space S2 by one exhaust unit 30. In the fourth ventilator 14, the number of the exhaust units 30 is smaller than the number of the air supply units 20. This configuration facilitates installation of the fourth ventilator 14. In the present embodiment, the fourth ventilator 14 including one exhaust unit 30 is exemplified, but the number of the exhaust units 30 in the fourth ventilator 14 is not limited to one, and may be divided into two or more. In the fourth ventilator 14, by arranging the exhaust fan 32 in the outdoor space S2, noise in the indoor space S1 can be suppressed even when a large fan that processes a return air amount corresponding to a total air supply amount of the plurality of air supply units 20 is used as the exhaust fan 32. Similarly, by arranging the second heat exchanger 33 in the outdoor space S2, it is possible to use a large heat exchanger that processes an amount of heat for the return air amount corresponding to the total air supply amount of the plurality of air supply units 20. Similarly to the second ventilator 12, the second heat exchanger 33 may be provided in the indoor space S1. When the second heat exchanger 33 is provided in the indoor space S1, a plurality of heat exchangers may be provided in parallel.

(Fifth Ventilator)

Figure 9:
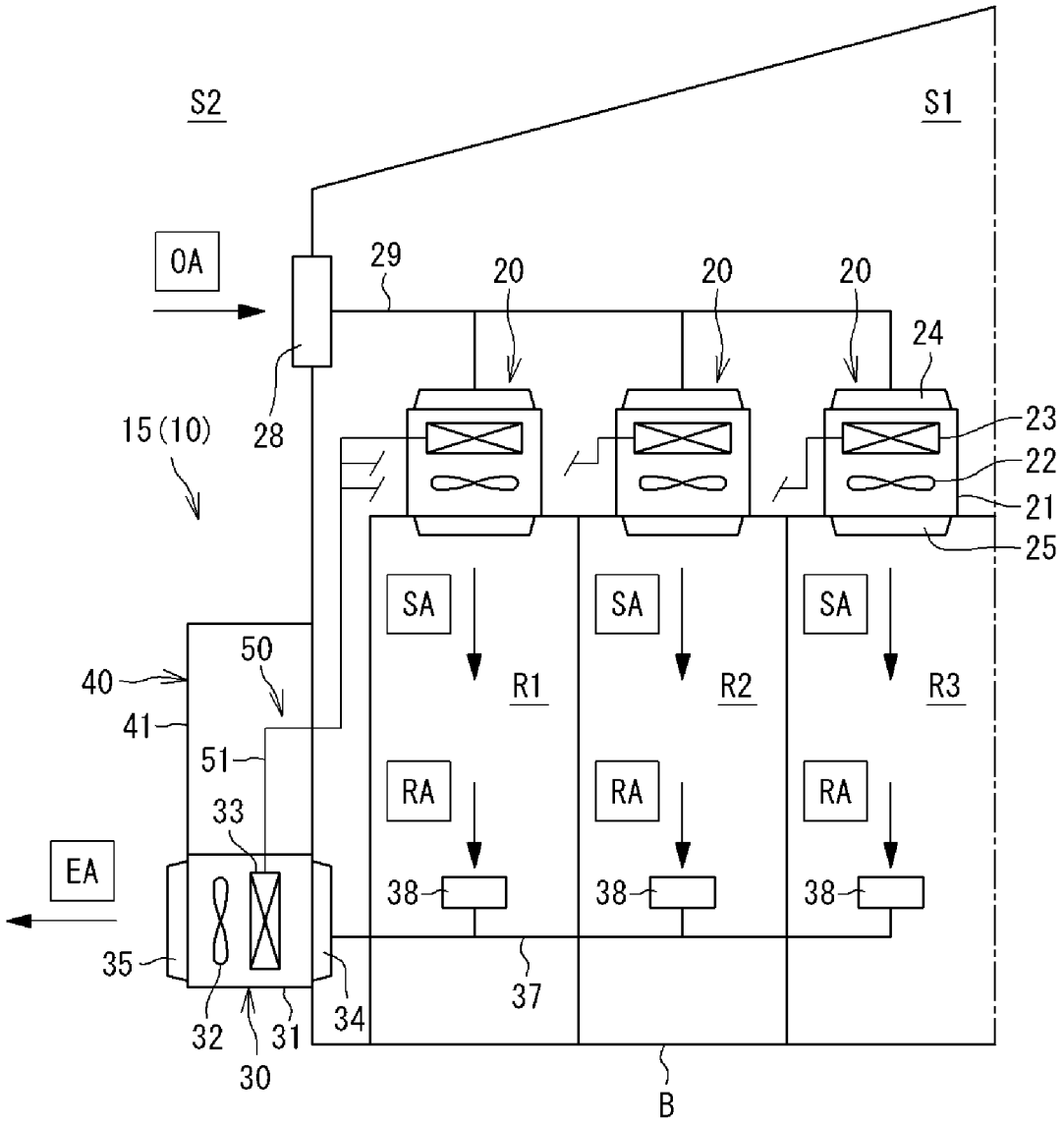
FIG. 9 is a schematic view showing a schematic arrangement of a ventilator according to a fifth embodiment of the present disclosure.

As shown in FIG. 9, the fifth ventilator 15 is different from the fourth ventilator 14 in that a return air duct 37 connected to the exhaust unit 30 and a plurality of suction ports 38 provided in the return air duct 37 are provided. The fifth ventilator 15 can be applied to the building B in which the indoor space S1 is partitioned into a plurality of rooms R1 to R3.

In the fifth ventilator 15, one air supply unit 20 and one suction port 38 are disposed in each of the rooms R1 to R3. In the present embodiment, the number of the air supply units 20 and the number of the suction ports 38 disposed in one room may be the same. However, the air supply amount of the air supply unit 20 and the return air amount sucked from the suction port 38 are only required to be balanced in each of the rooms R1 to R3, and the number of the air supply units 20 and the number of the suction ports 38 are not required to be the same.

In the fifth ventilator 15, the outside air OA taken in from an outside air inlet 28 provided in the outer wall of the building B is distributed to each air supply unit 20 by an air supply duct 29. In the fifth ventilator 15, the first heat exchanger 23 is disposed in each of the rooms R1 to R3, and each of the air supply units 20 is provided with the expansion valve 44. Therefore, in the fifth ventilator 15, the air supply units 20 in the rooms R1 to R3 can individually adjust a supply air temperature. In the fifth ventilator, the air supply fan 22 individually supplies the supply air SA to each of the rooms R1 to R3, and the exhaust fan 32 sucks the return air RA having an amount balanced with an amount of the supply air SA from the suction port 38. In the fifth ventilator, the return air RA sucked from the suction port 38 of each of the rooms R1 to R3 by the exhaust fan 32 is collected by the return air duct 37 and discharged as the exhaust air EA to the outdoor space S2. The suction port 38 provided in each of the rooms R1 to R3 includes an air volume adjustment mechanism (not shown), which can individually adjust an intake amount of the suction port 38 (an air volume of the return air RA in each of the rooms R1 to R3). The air volume adjustment mechanism may be provided separately from the suction port 38, and the air volume adjustment mechanism in this case may be a damper, a fan unit having an air volume adjustment function, or the like.

As shown in FIG. 9, in the fifth ventilator 15, a portion other than the plurality of air supply units 20 is disposed in the outdoor space S2, and the plurality of air supply unit 20 is disposed in the indoor space S1. In this case, the exhaust-side casing 31 and the exhaust fan 32 are disposed in the outdoor space S2. Therefore, in the fifth ventilator 15, it is possible to increase the distance attenuation amount during transmission of noise generated by the exhaust fan 32 to the indoor space S1 as compared with the conventional ventilator. Accordingly, in the fifth ventilator 15, noise in the indoor space S1 can be suppressed.

In the fifth ventilator 15, the first heat exchanger 23 is provided in each of the rooms R1 to R3 in order to individually adjust the temperature of the supply air SA. However, since a temperature of the exhaust air EA does not need to be adjusted (in other words, the temperature of the exhaust air EA may be natural), the second heat exchanger 33 does not need to be provided separately in each of the rooms R1 to R3. Therefore, in the fifth ventilator 15, the return air RA in each of the rooms R1 to R3 is collected and processed by one exhaust unit 30. In the fifth ventilator 15, by reducing the number of the exhaust units 30, an installation space of the exhaust units 30 in the outdoor space S2 can be easily secured, and man-hours required for installation can also be reduced. In the fifth ventilator 15, by arranging the exhaust fan 32 in the outdoor space S2, noise in each of the rooms R1 to R3 can be suppressed even when a large fan that processes a return air amount corresponding to a total air supply amount of the plurality of air supply units 20 is used as the exhaust fan 32. Similarly, by arranging the second heat exchanger 33 in the outdoor space S2, it is possible to use a large heat exchanger that processes an amount of heat for the return air amount corresponding to the total air supply amount of the plurality of air supply units 20. Similarly to the second ventilator 12, the second heat exchanger 33 may be provided in the indoor space S1. When the second heat exchanger 33 is provided in the indoor space S1, a plurality of heat exchangers may be provided integrally with or separately from the suction ports 38 of the rooms R1 to R3.

Functional Effects of Embodiment (1) The ventilator 10 of the present disclosure includes the refrigerant circuit 50 through which the refrigerant flows, the refrigerant circuit 50 including the compressor 42, the first heat exchanger 23, and the second heat exchanger 33 that are connected by the refrigerant pipe 51, the air supply fan 22 that supplies air in an outdoor space S2 to the indoor space S1 through the first heat exchanger 23, the exhaust fan 32 that exhausts air in the indoor space S1 to the outdoor space S2 through the second heat exchanger 33, and the exhaust-side casing 31 that accommodates the exhaust fan 32, in which the exhaust fan 32 and the exhaust-side casing 31 are disposed in the outdoor space S2.

In the ventilator 10 having such a configuration, noise in the indoor space S1 can be suppressed by installing the exhaust fan 32 in the outdoor space S2. In the ventilator 10 having such a configuration, since the exhaust fan 32 disposed in the outdoor space S2 is accommodated in the exhaust-side casing 31, the noise of the exhaust fan 32 is less likely to be transmitted to the indoor space S1.

(2) In the ventilator 10 of the present disclosure, the second heat exchanger 33 is accommodated in the exhaust-side casing 31.

In the ventilator 10 having such a configuration, since the exhaust fan 32 and the second heat exchanger 33 are accommodated in the exhaust-side casing 31 to be unitized, construction of ducts and refrigerant pipes around the exhaust fan 32 and the second heat exchanger 33 in a construction site is facilitated.

(3) The fifth ventilator 15 of the present disclosure further includes the air supply-side casing 21, and the plurality of air supply units 20 that accommodates the first heat exchanger 23 and the air supply fan 22 in the air supply-side casing 21, in which the plurality of air supply units 20 individually supplies the air in the outdoor space S2 to the indoor space S1.

In the fifth ventilator 15 having such a configuration, when the indoor space S1 is divided into the plurality of rooms R1 to R3, the air supply unit 20 can individually supply the supply air SA to each of the rooms R1 to R3.

(4) In the fifth ventilator 15 of the present disclosure, the exhaust fan 32 exhausts the air in the indoor space S1 to the outdoor space S2 through the plurality of suction ports 38 that is disposed in the indoor space S1 and sucks the air in the indoor space S1.

In the fifth ventilator 15 having such a configuration, the number of the exhaust fans 32 can be reduced.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 ventilator
11 first ventilator
12 second ventilator
13 third ventilator
14 fourth ventilator

15 fifth ventilator
20 air supply unit
21 air supply-side casing
22 air supply fan
23 first heat exchanger
30 exhaust unit
31 exhaust-side casing
32 exhaust fan
33 second heat exchanger
38 suction port
42 compressor
50 refrigerant circuit
51 refrigerant pipe
S1 indoor space
S2 outdoor space

What is claimed is:

1. A ventilator comprising:

a refrigerant circuit through which a refrigerant flows and that comprises: a compressor, first heat exchangers, and a second heat exchanger that are connected by a refrigerant pipe;

air supply fans that supply air from an outdoor space to indoor spaces through the first heat exchangers;

an exhaust fan that exhausts air from the indoor spaces to the outdoor space through the second heat exchanger;

an exhaust-side casing that accommodates the second heat exchanger and the exhaust fan;

air supply-side casings that accommodate the air supply fans; and air supply units that accommodate the first heat exchangers and the air supply fans in the air supply-side casings, wherein the exhaust-side casing is separated away from the air supply-side casings, the exhaust fan and the exhaust-side casing are disposed in the outdoor space, and each of the air supply units supplies the air from the outdoor space to a respective one of the indoor spaces.

2. The ventilator according to claim 1, wherein the second heat exchanger is accommodated in the exhaust-side casing.

3. The ventilator according to claim 1, wherein the exhaust fan exhausts the air from the indoor spaces to the outdoor space through suction ports disposed in the indoor spaces and that suck the air in the indoor spaces.

4. The ventilator according to claim 1, wherein each of the air supply-side casings has a side surface that has a blow-out port for supplying air to the respective one of the indoor spaces.

5. The ventilator according to claim 4, wherein the exhaust-side casing has a side surface that a suction port for sucking air from the indoor spaces, and the suction port is disposed on an outer wall surface of a building.

6. The ventilator according to claim 1, further comprising:

a return air duct connected to an exhaust unit; and suction ports that individually suck the air from the indoor spaces, wherein the suction ports are disposed in the return air duct.

7. The ventilator according to claim 6, further comprising an air volume adjustment mechanism for adjusting intake amounts of the suction ports.

8. The ventilator according to claim 4, further comprising:

a return air duct connected to an exhaust unit; and suction ports that individually suck the air from the indoor spaces, wherein the suction ports are disposed in the return air duct.

9. The ventilator according to claim 8, further comprising an air volume adjustment mechanism for adjusting intake amounts of the suction ports.

* * * * *